United States Patent [19]

Faye

[11] Patent Number: 4,745,657

[45] Date of Patent: May 24, 1988

[54] HINGED SUPPORT BRACKET ASSEMBLY FOR A DRAIN TROUGH

[76] Inventor: Lloyd H. Faye, 8821 Elm Rd., Richmond, Va. 23235

[21] Appl. No.: 917,890

[22] Filed: Oct. 14, 1986

[51] Int. Cl.[4] ..... E05D 5/06; E04D 13/00; E04D 13/06

[52] U.S. Cl. ..... 16/226; 16/389; 16/390; 16/392; 16/DIG. 29; 52/11; 248/48.2

[58] Field of Search ..... 16/226, 227, 387, 389, 16/390, 391, 392, DIG. 29; 52/11, 12; 248/48.1, 48.2

[56] References Cited

U.S. PATENT DOCUMENTS

| | | | |
|---|---|---|---|
| 4,014,074 | 3/1977 | Faye | 16/392 |
| 4,309,792 | 1/1982 | Faye | 16/389 |
| 4,311,292 | 1/1982 | Deason | 248/48.2 |
| 4,389,748 | 6/1983 | Grossman | 16/278 |
| 4,413,449 | 11/1983 | Faye | 52/16 |
| 4,561,616 | 12/1985 | Robinson | 248/48.2 |
| 4,669,232 | 2/1987 | Wyatt | 16/389 |

*Primary Examiner*—Nicholas P. Godici
*Assistant Examiner*—Edward A. Brown
*Attorney, Agent, or Firm*—Norman B. Rainer

[57] ABSTRACT

A hinged support bracket for a drain trough is disclosed having a harness member which nests above a bracket member. Both harness and bracket members are joined by a hinge mechanism at their forward extremities, thereby permitting the harness member, containing the drain trough, to be forwardly rotated at least 180 degrees of circular arc, causing inversion of the trough and the discharge of any debris contained therein.

2 Claims, 3 Drawing Sheets

HINGED SUPPORT BRACKET ASSEMBLY FOR A DRAIN TROUGH

BACKGROUND OF THE INVENTION

This invention relates to an improvement in a drain trough system generally associated with the eaves of a roof of a building, and is more particularly concerned with a device which facilitates the mounting and maintenance of drain troughs.

Most residential-type houses or dwellings are constructed with pitched roofs, the sloped nature of which prevents the accumulation of water thereon. Beneath the lower extremity of a pitched roof, generally referred to as the eaves, there is positioned a drain trough or gutter, the purpose of which is to catch water which runs off the roof, and channel it to a downspout which leads the water away from the foundation of the house.

In the course of time, such drain troughs tend to accumulate debris such as fallen leaves, which obstructs the trough, thereby rendering it ineffective for its intended purpose. Also, in the course of time, the trough, usually of metal construction, may require maintenance such as scraping and/or painting. The servicing of such troughs for the purposes of cleaning or painting generally requires the use of a ladder, which makes the task difficult and often perilous.

Although a number of approaches have been previously disclosed for simplifying the servicing of eaves-mounted drain troughs, none have been completely successful in operation or sufficiently practical to enjoy widespread commercial utilization. Structurally modified drain trough systems have been proposed, such as those disclosed in U.S. Pat. Nos. 538,108, 4,117,635 and 4,116,008 which enable the trough to be tilted or inverted so that its contents will dump out. However, some of said prior systems require use of costly non-standard, specifically designed drain troughs, and some involve intricate mechanical features susceptible to malfunction caused by said debris. Also, their installation onto the eaves of a house may be difficult, particularly in the case of modern houses wherein the roof overhangs by not more than about two inches the upper peripheral wooden trim panels of the underlying walls, said panels being generally referred to as the fascia.

The use of hinged brackets to mount a standard drain trough to the fascia in a manner permitting inversion of said trough to discharge its contents has been disclosed in U.S. Pat. Nos. 4,014,074; 4,309,792; and 4,413,449. Although the functionality of such hinged bracket is unaffected by the presence of debris, improvements appear needed in the ease of fabrication of such hinged brackets and in their durability and ease of attachment to the drain trough. Earlier brackets have had to be attached to the trough by way of penetrative fasteners applied to lower portions of the trough. Such manner of attachment is conducive to water leakage through the trough and resultant corrosive degradation.

It is accordingly an object of this invention to provide an improved hinged bracket for use in mounting a conventional drain trough to the fascia of a building.

It is another object of this invention to provide a bracket as in the foregoing object adapted to permit said trough to be inverted so as to discharge its contents.

It is a further object to provide a bracket of the aforesaid nature which, in comparison with prior devices, is of more sturdy construction, less costly to fabricate, and easier to install.

These objects and other objects and advantages of the invention will be apparent from the following description.

SUMMARY OF THE INVENTION

The above and other beneficial objects and advantages are accomplished in accordance with the present invention by an improved hinged support bracket assembly comprising an upper harness member pivotably joined to a lower bracket member.

The harness member is constructed so as to enclasp a conventional drain trough in a manner such that the trough is slideably adjustable within the harness during the installation process, and may then be fixedly fastened to the harness by way of penetrative fasteners applied to the uppermost portion of the trough. The contour of the harness member is such as to permit the drain trough, when seated within the harness member, to fit closely against the fascia of a building, as in the usual manner of installing a conventional drain trough on houses of current design. The harness member is comprised of a flat rear panel, and a flat bottom panel perpendicularly emergent from the lowermost extremity of the rear panel and terminating in a front extremity. Associated with the front extremity of the bottom panel is a circular cylindrical channel adapted to receive a cylindrical shaft which serves as a pivot pin. An overhead panel emerges from the uppermost extremity of the rear panel and extends above said bottom panel to a forward extremity. The harness member is a substantially monolithic structure derived by cutting an extruded metal structure in a direction transverse to its axis of elongation.

The bracket member has a generally L-shaped configuration comprised of a flat vertical panel and a horizontal panel which emerges perpendicularly from the lowermost extremity of said vertical panel and terminates in a forward extremity. Means are associated with said vertical panel for attachment to the fascia of a building. Associated with said forward extremity is a circular cylindrical channel adapted to align with the channel of said harness member in receiving said pivot pin. In a preferred embodiment, the bracket member is provided with two spaced-apart channels disposed in a manner to embrace a single channel of said harness member so that said pivot pin may extend through all three channels. The height of the vertical panel of the bracket member is greater than the height of the rear panel of the harness member. The bracket member, like the harness member is a monolithic structure derived from extruded metal stock.

The harness member is adapted to rest in nested relationship above said bracket member when said pivot pin interengages the channels of both members. In such manner of disposition, the harness member is capable of rotating through about 180 degrees of circular arc about said pivot pin. The overhead panel of the harness member is provided with retaining and attachment means to facilitate securement of the drain trough, and means for directing water into the trough.

The hinged support bracket is further provided with stopping means which limit the extent of pivotal movement of said harness member with respect to said bracket member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
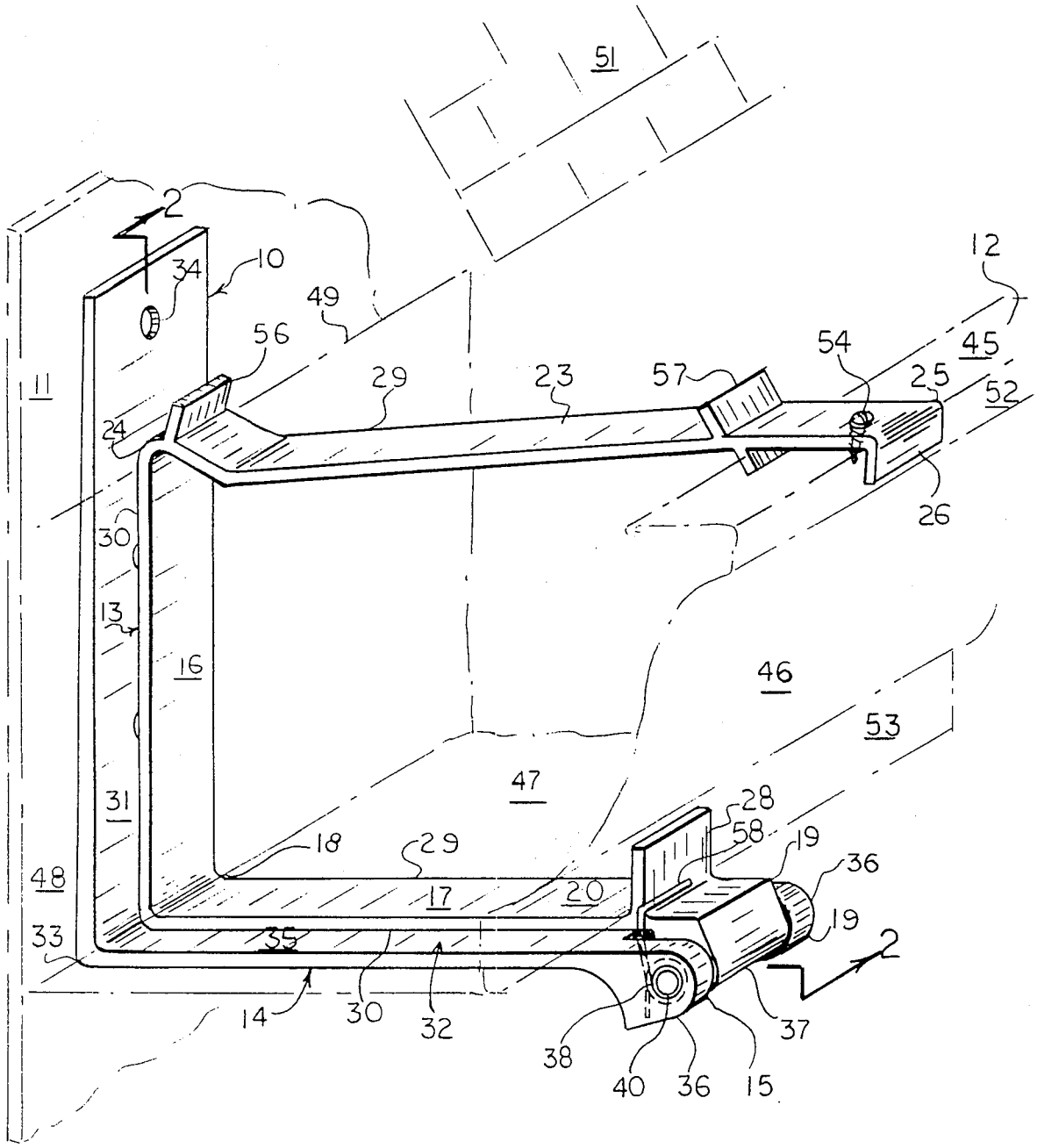
FIG. 1 is a perspective view of an embodiment of the support bracket assembly of the present inventon showing a portion of a drain trough positioned in upright mode within said support bracket assembly.

Referring to FIG. 1, a hinged support bracket assembly 10 of this invention is shown attached to the fascia 11 of a building and supporting a drain trough 12 in an upright mode adapted to catch rainwater from a roof 51 disposed above said fascia. The support bracket assembly is comprised of harness member 13, underlying bracket member 14, and hinge means 15 which interengage said harness and bracket members. The drain trough is of conventional design, fabricated of metal or plastic by rollforming or equivalent methods. The trough is provided with a forward lip 45 formed as a narrow horizontally disposed strip bent rearwardly from the front face of the trough. Said front face is comprised of upper shoulder 52 contiguous to forward lip 45, curved portion 46, and lower shoulder 53 contiguous to curved portion 46. The trough is further provided with a flat bottom 47 and flat rear panel 48. The upper edge 49 of rear panel 48 is substantially coplanar with forward lip 45.

Figure 4:
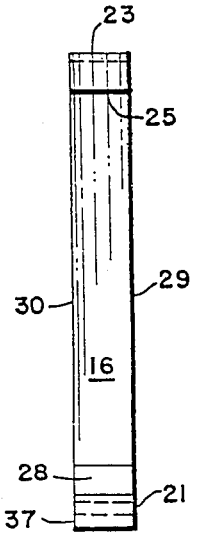
FIG. 4 is a front view of the harness member of the embodiment of FIG. 1.

The harness member is a monolithic structure cut from an aluminum extrusion, and comprised of flat rear panel 16, and bottom panel 17 which emerges perpendicularly from the lowermost extremity 18 of rear panel 16, forming therewith an L-shaped configuration. Bottom panel 17, having a flat upper surface 20, extends to and terminates in a front extremity 19. Said bottom panel, adjacent front extremity 19, is provided with a thick portion 37 which houses circular cylindrical channel 21, shown more clearly in FIGS. 2 and 4. The forward extremity of thick portion 37 has a substantially flat abutment surface 22 disposed substantially perpendicular to upper surface 20.

Overhead panel 23 emanates from the upper extremity 24 of rear panel 16 as a continuous integral extension thereof. Said overhead panel is disposed above and substantially parallel to bottom panel 17, and terminates in a leading edge 25 which extends forwardly of abutment surface 22 of underlying bottom panel 17. Retaining tabs 26 and 27 extend downwardly from the overhead panel to function as forward gripping means which embrace forward lip 45 of the trough. It is to be noted that the rearward extremity of the overhead panel is downwardly bent so as to constitute rearward gripping means for engaging upper edge 49 of the rear panel of the trough. The bend also serves as directing means whereby water falling upon the overhead panel is caused to enter the trough. A lower retaining tab 28 rises upwardly from the forward extremity of bottom panel 17 and is adapted to abut against lower shoulder 53 of the trough.

The harness member has a degree of flexural resiliency sufficient to enable the overhead and bottom panels to be temporarily forced apart by about $\frac{1}{4}''$ to $\frac{3}{4}''$. When said panels are forced apart, the harness member can be pushed onto the trough from the direction of the rear panel 48 of the trough. Once in place and released, the harness member enclasps the trough in spring-like manner, gripping the trough about its entire periphery except for the curved portion of its front face. In such gripped mode, the trough can be slidably positioned within the harness member. When the harness member is positioned at a sought location with respect to the long axis of the trough, a metal screw 54 is inserted through the overhead panel to engage the underlying lip 45 of the trough. Because of the elevated location of screw 54, no sealer is required. A preformed aperture 55 is preferably provided in the overhead panel to accommodate screw 54.

The overhead panel further provides a strengthening or reinforcing effect to the enclasped trough. Paired water directing tabs 56 and 57 are upwardly directed from opposite extremities of the overhead panel, and serve to prevent water from running upon the overhead panel beyond the front and rear extremities of the underlying trough. In view of its manner of fabrication from an extruded metal form, the cross-sectional configuration of the harness member, taken in vertical planes extending between forward and rearward extremities, is substantially constant, and the opposite side edges 29 and 30 of the panels lie in parallel planes.

Figure 2:
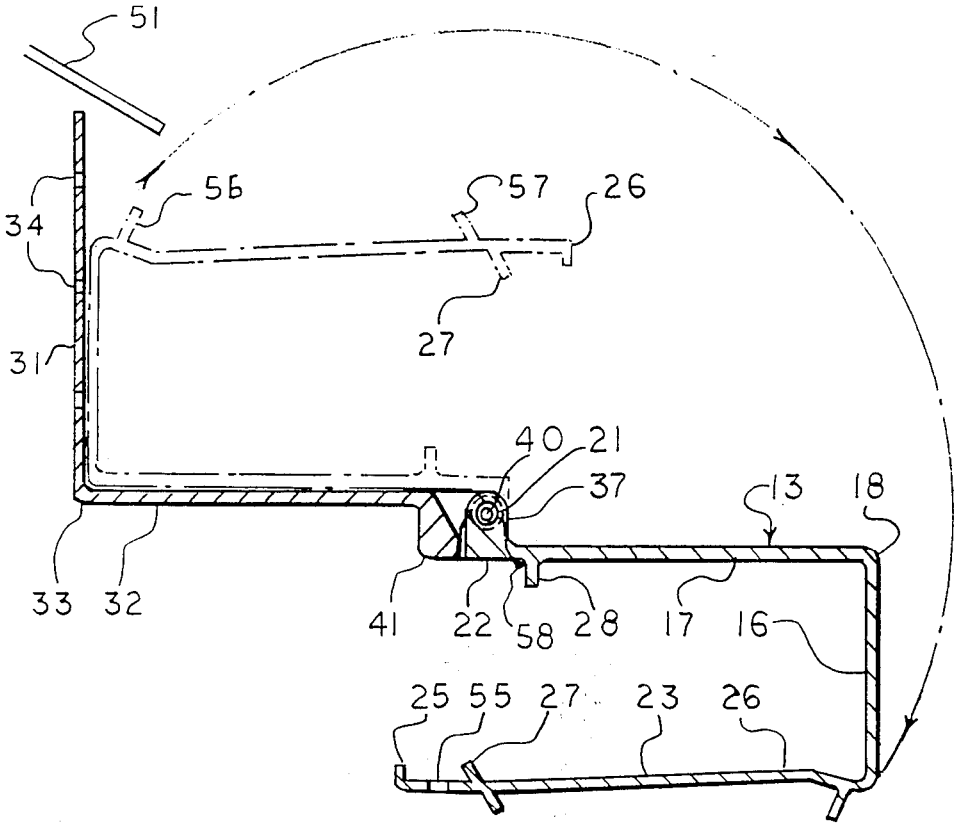
FIG. 2 is a sectional side view of the hinged support bracket taken along the line 2—2 of FIG. 1, and showing the harness member positioned in the inverted mode.
Figure 3:
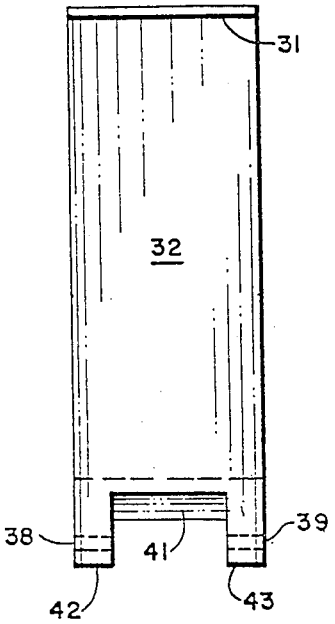
FIG. 3 is a top view of the bracket member of the embodiment of FIG. 1.

Bracket member 14 is comprised of flat vertical panel 31 and horizontal panel 32 which emerges perpendicularly from the lowermost extremity 33 of said vertical panel, forming therewith an L-shaped configuration. Vertical panel 31 is provided with fastening means in the form of apertures 34 which perit insertion of a nail, screw or other penetrative fastener adapted to engage fascia 11. As shown in FIGS. 1 and 2, uppermost aperture 34 is positioned higher than overhead panel 23. Such position of the uppermost aperture 34 permits attachment of the bracket assemblies to the fascia while engaging the trough in its upright mode, thereby simplifying alignment of the several assemblies so that the trough has a proper downward angle in the direction of the downspout.

Horizontal panel 32, having a flat upper surface 35, extends to and terminates in a forward bifurcated extremity 36 having a greater thickness than the remainder of panel 32. Coaxially aligned circular cylindrical channels 38 and 39, having diameters larger than the diameter of channel 21, are positioned within extremity 36 in parallel juxtaposition with respect to both extremity 36 and upper surface 35. Although bracket member 14 does not have a constant cross-sectional configuration throughout its width, it can nevertheless be fabricated from extruded shapes by transverse cutting thereof and removal of the central portion of forward extremity 36.

The hinged support bracket is assembled in such a manner that the harness member lies above the bracket member in nesting engagement therewith, the thick portion of the front extremity of bottom panel 17 of said harness member being embraced by the forward bifurcated extremity of the bracket member. A pivot pin 40 in the form of a cylindrical metal tube having a longitudinal slit which permits spring-like resilience is forced into channel 21 in tight-fitting frictional engagement therewith. The extremities of pin 40 extend into loose-fitting engagement with opposed channels 38 and 39 which are of larger diameter than channel 21. By virtue of such arrangement, the harness member is enable to rotate at least 180 degrees of circular arc about the forward extremity of the bracket member while having a controlled amount of lateral wobble. The intentionally produced a wobble enables the support bracket assembly to function properly when a multitude of the assemblies are installed onto a length of gutter trough which is not absolutely straight. In principle, unless all the support bracket assemblies are in perfect alignment with respect to the axes of the pivot pins they could not easily function. Because such perfect alignment is rarely achievable, the wobble capability permits practical operation of the assemblies.

As shown most clearly is FIG. 2, rotation of the harness member is halted when abutment surface 22 comes in contact with shoulder 41 positioned between the channel-containing protrusions 42 and 43 comprising the forward extremity of horizontal panel 32 of the bracket member. It should be noted that the configuration of the support bracket assembly is such that the rear of the trough is caused to lie against the fascia, but will not hit the roof during inversion.

In use, a plurality of the hinged support brackets of this invention are utilized in horizontally spaced alignment to hold a length of drain trough. Each bracket member is attached to the fascia of the building by fastening means such as nails, screws, or adhesive acting upon vertical panel 31. When the drain trough is inverted by the forward pivotal movement of the several harness members acting in unison, debris contained within the drain trough is discharged. While in its inverted position, the interior of the drain trough is readily accessible for cleaning or other maintenance operations.

Spring means may be associated with the forward extremities of the interengaged bracket and harness members for the purpose of facilitating return of the trough from its inverted state to its upright state. The spring means may also prevent inadvertent inversion of the trough by the effects of winds. In the illustrated embodiment, a spring 58 is mounted upon pivot pin 40, and disposed between protrusion 42 of the bracket member and thick portion 37 of the harness member. The spring, having a configuration known as a mousetrap spring has an upper leg which abuts retaining tab 28, and a lower leg which abuts shoulder 41 of the bracket member. The spring is restoratively stressed when the trough is in its inverted state.

Although specific embodiments of hinge means other than the specific one exemplified herein may be utilized, it is preferred that said hinge means extend the entire width of both harness and bracket members. Such preferred configuration imparts desirable strength and durability to the overall hinged support bracket structure. It is further preferred that the channel means of the hinge structure be comprised of at least three separate aligned sections, two of said sections serving to extend the effective length of a smaller diameter channel interposed therebetween.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention what is claimed is:

1. A hinged support bracket assembly for a drain trough comprising:

(a) a monolithic harness member comprised of a flat rear panel having uppermost and lowermost extremities, a bottom panel which emerges perpendicularly from the lowermost extremity of said rear panel and terminates in a front extremity, having a cylindrical channel, and an overhead panel emergent from the uppermost extremity of said rear panel and disposed directly above said bottom panel, said rear, overhead, and bottom panels being of substantially identical width, (b) a monolithic bracket member comprised of a flat vertical panel and a horizontal panel which emerges perpendicularly from the lowermost extremity of said vertical panel and terminates in a bifurcated forward extremity having two axially aligned circular cylindrical channels which embrace the front extremity of the bottom panel in axial alignment with the cylindrical channel thereof, said vertical and horizontal panels being of substantially identical width.

(c) said harness member being narrower than said bracket member and adapted to reside in nested relationship above said bracket member, (d) hinge means which join the front extremity of said bottom panel with the forward extremity of said horizontal panel in a manner to enable said harness member to rotate in at least 180 degrees of circular arc, said hinge means being comprised of the circular cylindrical channels associated with the joined extremities, and a cylindrical shaft which insertively engages said channels, and (e) stopping means which limit the extent of rotative movement of said harness member.

2. The bracket assembly of claim 1 wherein the channels of said bifurcated forward extremity are of larger diameter than the embraced channel of the front extremity of the bottom panel, whereby a controlled amount of wobble is imparted to the hinge means.

* * * * *